US008672133B2

(12) United States Patent
Liao et al.

(10) Patent No.: US 8,672,133 B2
(45) **Date of Patent: *Mar. 18, 2014**

(54) MULTI-SECTIONAL CLAMPING TYPE AIR ENCLOSURE

(75) Inventors: Chieh Hua Liao, Sindian (TW); Yaw Shin Liao, Sindian (TW); Yao Chuan Liao, Sindian (TW)

(73) Assignee: Chieh Hua Liao, Taipei County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/607,518

(22) Filed: Sep. 7, 2012

(65) Prior Publication Data

US 2013/0032504 A1 Feb. 7, 2013

Related U.S. Application Data

(63) Continuation of application No. 12/144,208, filed on Jun. 23, 2008, now abandoned.

(30) Foreign Application Priority Data

Aug. 23, 2007 (TW) ..... 96214016 U

(51) Int. Cl.
*B65D 81/02* (2006.01)

(52) U.S. Cl.
USPC ..... 206/522; 206/592; 410/119

(58) Field of Classification Search
CPC .. B65D 81/052; B65D 81/113; B65D 5/5054; B65D 5/5045; B65D 5/5016; B60P 7/06; B61D 45/008; A45C 7/0081
USPC ..... 410/119; 283/44, 37, 3; 206/594, 593, 206/592, 591, 522
See application file for complete search history.

(56) References Cited

U.S. PATENT DOCUMENTS

| | | | | |
|---|---|---|---|---|
| 5,469,966 | A * | 11/1995 | Boyer | 206/522 |
| 6,629,777 | B2 * | 10/2003 | Tanaka et al. | 383/3 |
| 6,913,803 | B2 * | 7/2005 | Peper | 428/35.2 |
| 6,978,893 | B2 * | 12/2005 | Peper | 206/522 |
| 7,000,767 | B2 * | 2/2006 | Tanaka et al. | 206/522 |
| 7,165,677 | B2 * | 1/2007 | Tanaka et al. | 206/522 |
| 7,168,566 | B2 * | 1/2007 | Anderson et al. | 206/522 |
| 7,201,273 | B2 * | 4/2007 | Chen et al. | 206/522 |
| 7,422,109 | B2 * | 9/2008 | Yoshifusa | 206/522 |
| 7,445,117 | B2 * | 11/2008 | Kojima et al. | 206/522 |
| 7,482,051 | B2 * | 1/2009 | Tanaka et al. | 428/178 |

(Continued)

FOREIGN PATENT DOCUMENTS

JP 08-034478 * 6/1996

*Primary Examiner* — J. Gregory Pickett
*Assistant Examiner* — Kaushikkumar Desai

(57) ABSTRACT

A multi-sectional clamping type air enclosure is constituted by connecting a second, a third, and a fourth air cylinder sheet(s) sequentially in series to a first air cylinder sheet, in which an air filling passageway is disposed in the first air cylinder sheet to allow air to be filled in a plurality of first air cylinders and the second air cylinder sheet(s), the third air cylinder sheet and the fourth air cylinder sheet(s) communicated therewith to be filled with air and expanded. Thereafter, the second air cylinder(s) and the fourth air cylinder sheet(s) are bended toward the third air cylinder sheet to form approximately a U-typed body, and auxiliary air cylinders of the air cylinder sheet are then bended toward main air cylinders of the air cylinder sheet to cause side air cylinders of the air cylinder sheet to be approximately perpendicular to the main air cylinders.

11 Claims, 10 Drawing Sheets

(56) References Cited

U.S. PATENT DOCUMENTS 7,533,772 B2 * 5/2009 Yoshifusa et al. ..... 206/522
2003/0096068 A1 * 5/2003 Peper ..... 428/34.1
2005/0006271 A1 * 1/2005 Nakagawa ..... 206/521
2005/0109656 A1 * 5/2005 Ishizaki ..... 206/522
2007/0065047 A1 * 3/2007 Kojima et al. ..... 383/3

* cited by examiner

FIG.8（PRIOR ART）

MULTI-SECTIONAL CLAMPING TYPE AIR ENCLOSURE

CROSS-REFERENCES TO RELATED APPLICATIONS

This application is a continuation of U.S. application Ser. No. 12/144,208, filed Jun. 23, 2008, which claims priority under 35 U.S.C. §119(a) on Patent Application No(s). 096214016 filed in Taiwan, R.O.C. on Aug. 23, 2007, the entire contents of which are hereby incorporated by reference.

FIELD OF INVENTION

The present invention relates to an air enclosure, and more particularly to a multi-sectional clamping type air enclosure.

BACKGROUND

At the present, bubble paper or Styrofoam is mostly used to wrap an article. But, there still is a problem such as bad cushioning effect or environmental pollution. For solving the deficits of the bubble paper and the Styrofoam, an air packing bag made from a resin film is developed; it is sealed to form air cylinders by means of hot sealing and an air filling entrance for allowing air to be filled in is disposed thereon. After air is filled in the air cylinders via the air filling entrance, the air packing bag can then be used as a cushioning material for an inside packing.

Please refer to FIG. 8. An air packing bag A10 is constituted by a plurality of air cylinders A11, and the plurality of air cylinders A11 are disposed with a first side wall A12 and a second side wall A13. Two sides of the first side wall A12 and the second side wall A13 are respectively provided with a plastic film A14; an accepting space A16 is allowed to form between the first side wall and the second side wall after the plastic films A14 are adhered to each other by means of hot sealing and an article may be placed in the accepting space A16 of the air packing bag A10, for example, U.S. Pat. No. 7,000,767 does.

Please refer to FIG. 9. An air packing bag A10 is constituted by a plurality of air cylinders A11, and the plurality of air cylinders are disposed with a plurality of bendable points thereby allowing the air cylinders A11 to be bended to form a first side wall A12 and a second side wall A13 through the bendable points A16 and form an accepting space A15 between the first side wall A12 and the second side wall A13, and an article can then be placed in the accepting space A15 of the air packing bag A10, for example, Taiwan Patent No. M278659 does.

However, the two air packing bags mentioned above can only be used for wrapping an article with the same size, and articles with a different shape or size are not allowed to wrap by using the same air packing bag. Besides, they are not suitable for use in an outer box with a different size such that it is not very convenient for them on use. Moreover, for manufacturing air packing bags with a different size, different production lines must be used to manufacture them, or procedures of the production line must be changed; this merely increase the production cost of an air packing bag and the procedures changing even more lower the production efficiency substantially.

SUMMARY

For improving an air packing bag structure, allowing articles with a different size or shape to share the same air packing bag and an outer box with a different size to be used for encasement, and further reducing the production cost of an air packing bag, the present invention is proposed.

The present invention proposes a multi-sectional clamping type air enclosure; it comprises:

a first air cylinder sheet, comprising a plurality of first air cylinders;

at least one second air cylinder sheet, communicated with the first air cylinder sheet and comprising:

a plurality of second main air cylinders; and a plurality of second side air cylinders and a plurality of second auxiliary air cylinders, disposed side by side at two sides of the plurality of second main air cylinders, each second side air cylinder being communicated with at least one second auxiliary air cylinder, a length of the second auxiliary air cylinder farther away from the plurality of second main air cylinders being longer;

a third air cylinder sheet, communicated with the second air cylinder sheet and comprising:

a plurality of third main air cylinders; and a plurality of third side air cylinders and a plurality of third auxiliary air cylinders, disposed side by side at two sides of the plurality of third main air cylinders, each third side air cylinder being communicated with at least one third auxiliary air cylinder, a length of the third auxiliary air cylinder farther away from the plurality of third main air cylinders being longer; and at least one fourth air cylinder sheet, communicated with the third air cylinder sheet and comprising:

a plurality of fourth main air cylinders; and a plurality of fourth side air cylinders and a plurality of fourth auxiliary air cylinders, disposed side by side at two sides of the plurality of fourth main air cylinders, each fourth side air cylinder being communicated with at least one fourth auxiliary air cylinder, a length of the fourth auxiliary air cylinder farther away from the plurality of fourth main air cylinders being longer.

wherein, after the second air cylinder sheet and the fourth air cylinder sheet are bended toward the third air cylinder sheet, the auxiliary air cylinders of the second air cylinder sheet, the third air cylinder sheet and the fourth air cylinder sheet are bended toward the main air cylinders to cause the side air cylinders of the second air cylinder sheet, the third air cylinder sheet and the fourth air cylinder sheet to be approximately perpendicular to the main air cylinders to clamp an article thereby being capable of providing the multi-facial cushioning effect for an article with a different shape or size, and allowing the article to be accepted in an outer box with a different size by bending the first air cylinder sheet, the second air cylinder sheet, the third cylinder sheet and the fourth sheet.

BRIEF DESCRIPTION OF THE DRAWINGS

The present invention can be more fully understood by reference to the following description and accompanying drawings, in which.

DETAILED DESCRIPTION

Figure 1:
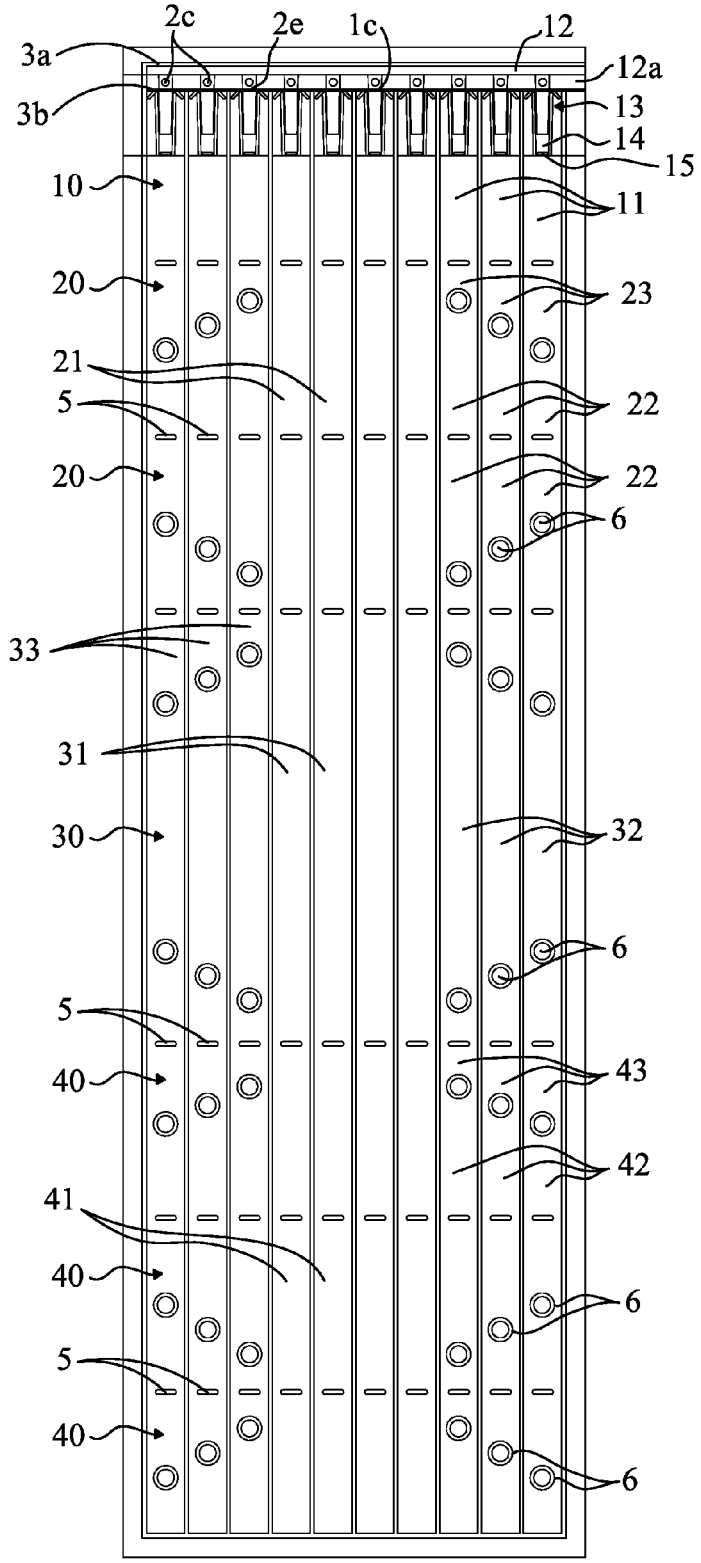
FIG. 1 is a plain view, showing a multi-sectional clamping type air enclosure of a first preferred embodiment according to the present invention before air is filled.
Figure 2:
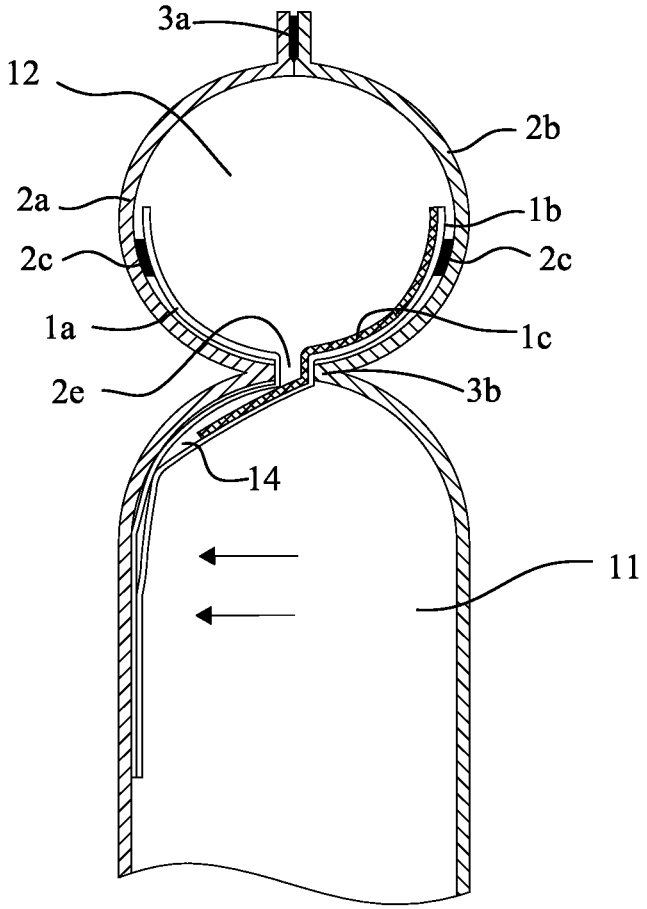
FIG. 2 is a cross sectional view, showing a multi-sectional clamping type air enclosure of the first preferred embodiment according to the present invention after air is filled.
Figure 3A:
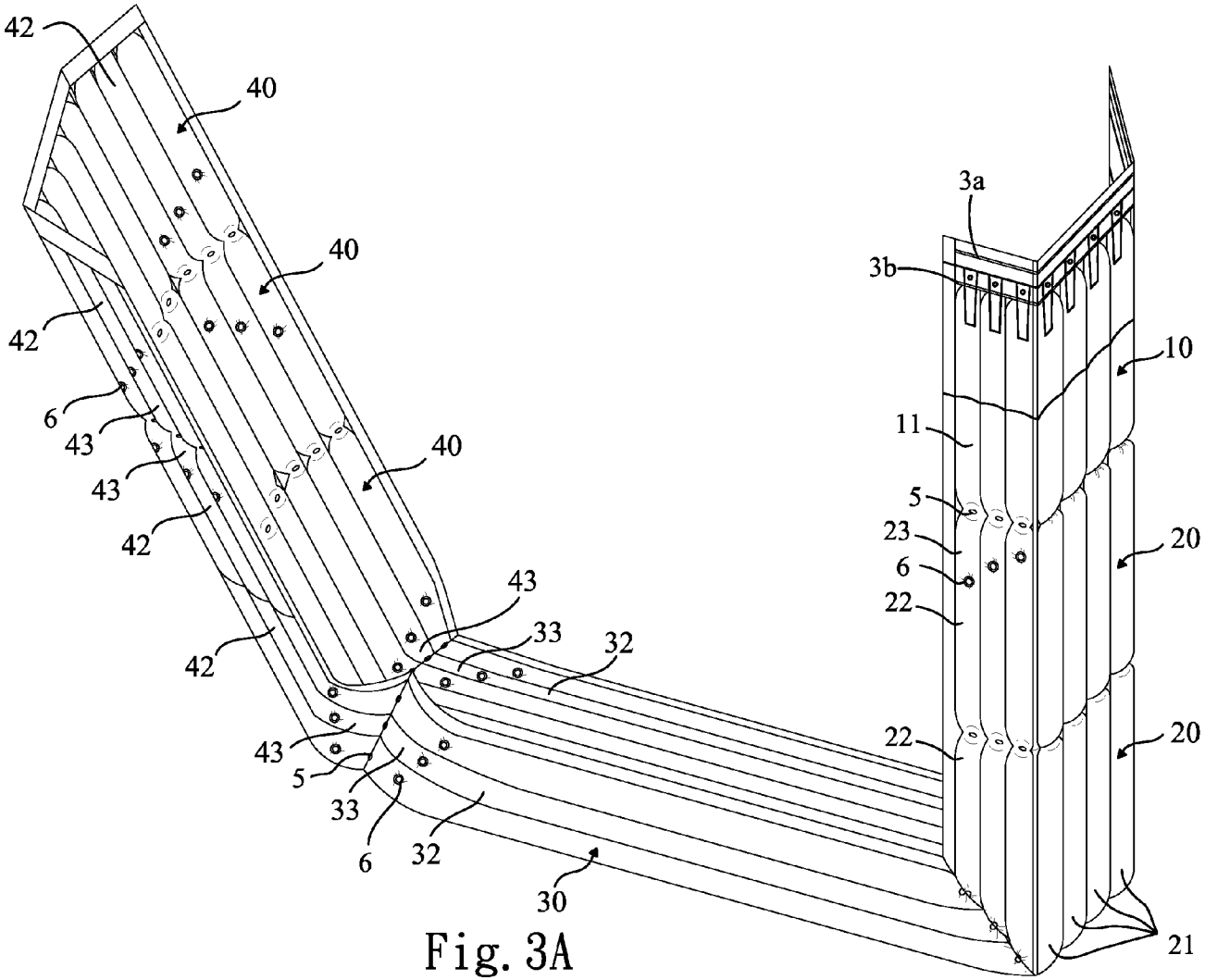
FIG. 3A is a perspective view, showing a multi-sectional clamping type air enclosure of the first a preferred embodiment according to the present invention after air is filled.
Figure 3B:
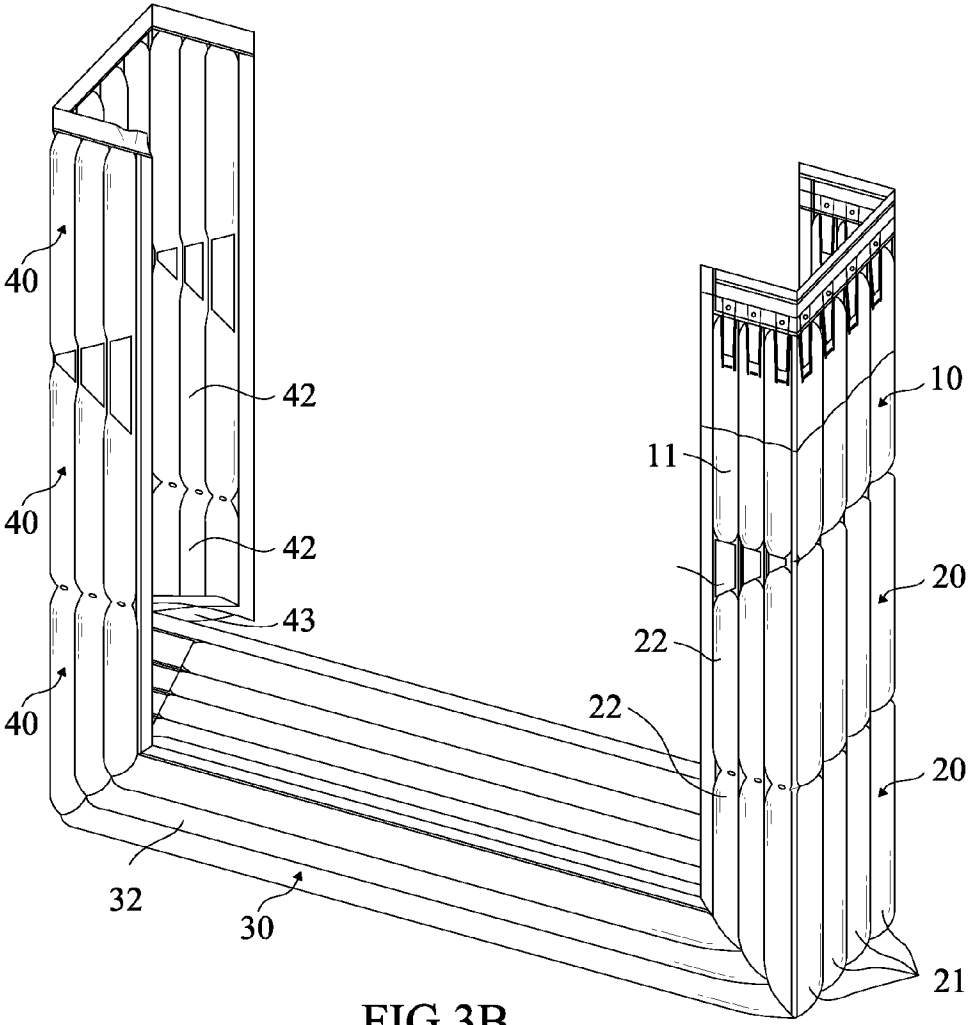
FIG. 3B is another perspective view, showing a multi-sectional clamping type air enclosure of the first preferred embodiment according to the present invention after air is filled.

Please refer to FIGS. 1, 2, 3A and 3B. FIG. 1 is a plain view, showing a multi-sectional clamping type air enclosure of a first preferred embodiment according to the present invention before air is filled. FIG. 2 is a cross sectional view, showing a multi-sectional clamping type air enclosure of the first preferred embodiment according to the present invention after air is filled. FIG. 3A is a perspective view, showing a multi-sectional clamping type air enclosure of the first a preferred embodiment according to the present invention after air is filled. FIG. 3B is another perspective view, showing a multi-sectional clamping type air enclosure of the first preferred embodiment according to the present invention after air is filled.

A multi-sectional clamping type air enclosure comprises a first air cylinder sheet 10, a second air cylinder sheet 20, a third air cylinder sheet 30 and a fourth air cylinder sheet 40.

The first air cylinder sheet 10 comprises a plurality of first air cylinders 11 and an air filling passageway 12, in which the air filling passageway 12 is positioned at one side of the plurality of first air cylinders 11 and used for allowing air to be filled in the plurality of first air cylinders 11. Besides, the first air cylinder sheet 10 further comprises a continuous check valve 13 used for communicating the air filling passageway 12 with the plurality of first air cylinders 11. Air in the air filling passageway 12 is filled into the plurality of first air cylinders 11 via the continuous check valve 13 and the plurality of first air cylinders are then sealed by the continuous check valve 13 to enable air in the plurality of first air cylinders 11 not to be leaked out.

Two second air cylinder sheets 20 are sequentially connected in series to one side of the first air cylinders 10 and communicated with the first air cylinder sheet 10. Each second air cylinder sheet 20 comprises a plurality of second main air cylinders 21, a plurality of second side air cylinders 22 and a plurality of second auxiliary air cylinders 23, in which the plurality of second side air cylinders 22*a* disposed side by side at two sides of the plurality of second main air cylinders and a length of the second side air cylinder 22 farther away from the plurality of second main air cylinders 21 is shorter. The plurality of second auxiliary air cylinders 23 are disposed at two sides of the plurality of second main cylinders 21 and a length of the second auxiliary air cylinder 23 farther away from the plurality of second main air cylinder is longer. Each second side air cylinder 22 is communicated with at least one second auxiliary air cylinder 23 and a sum of lengths of the second auxiliary air cylinder 23 and the second side air cylinder communicated with each other is approximately equal to a length of the second main air cylinder 21.

The third air cylinder sheet 30 is connected in series to one side of the second air cylinder sheet 20 and communicated with the second air cylinder sheet 20; it comprises a plurality of third main air cylinders 31, a plurality of third side air cylinders 32 and a plurality of third auxiliary air cylinders 33, in which the plurality of third side air cylinders 32 are disposed side by side at two sides of the plurality of third main air cylinder 31 and a length of the third side air cylinder 32 farther away from the plurality of third main air cylinders 31 is shorter. The plurality of third auxiliary air cylinders 33 are disposed side by side at two sides of the plurality of third main air cylinders 31 and a length of the third auxiliary air cylinder 33 farther away from the third main air cylinder 31 is longer. Each third side air cylinder 32 is communicated with at least one third auxiliary air cylinder 33 and a sum of lengths of the third auxiliary air cylinder 33 and the third side air cylinder 32 communicated with each other is approximately to a length of the third main air cylinder 31. Moreover, the third auxiliary air cylinder 33 is connected in series to the second auxiliary air cylinder 23 and communicated with the second auxiliary air cylinder 23.

Three fourth air cylinder sheet 40 is sequentially connected in series to one side of the third air cylinder sheet 30 and communicated with the third air cylinder sheet 30. Each fourth air cylinder sheet 40 comprises a plurality of fourth main air cylinders 41, a plurality of fourth side air cylinders 42 and a plurality of fourth auxiliary air cylinders, in which the plurality of fourth side air cylinders 32 are disposed side by side at two sides of the plurality of fourth main air cylinder 31 and a length of the fourth side air cylinder 32 farther away from the plurality of fourth main air cylinders 31 is shorter. The plurality of fourth auxiliary air cylinders 33 are disposed side by side at two sides of the plurality of fourth main air cylinders 31 and a length of the fourth auxiliary air cylinder 33 farther away from the fourth main air cylinder 31 is longer. Each fourth side air cylinder 32 is communicated with at least one fourth auxiliary air cylinder 33 and a sum of lengths of the fourth auxiliary air cylinder 33 and the fourth side air cylinder 32 communicated with each other is approximately to a length of the fourth main air cylinder 31. Moreover, the fourth auxiliary air cylinder 33 is connected in series to the third auxiliary air cylinder 33 and communicated with the third auxiliary air cylinder 33.

Two outer layers 2*a* and 2*b* are provided, one overlying the other. Two inner layers 1*a* and 1*b* are between the two outer layers 2*a* and 2*b*. On one plane of the inner layers 1*a* and 1*b* not facing the outer layers 2*a* and 2*b* is coated with multiple heat resistant material 1*c* on the regions along the plane. The first air cylinder sheet 10, the second air cylinder sheet 20, the third air cylinder sheet 30 and the fourth air cylinder sheet 40 are formed by adhering two sheets of outer film 2*a* and 2*b* to each other by means of hot sealing. Please refer to FIGS. 1 and 2, two hot sealing lines 3*a* and 3*b* are positioned on one end of the two outer films 2*a* and 2*b* (one end of first air cylinder sheet 10) for adhering the two outer films 2*a* and 2*b* together. The air filling passageway 12 is positioned between two hot sealing lines 3*a* and 3*b* and including a space formed between the two outer films 2*a* and 2*b*. The continuous check valve 13 is formed by adhering two sheets of inner film 1*a* and 1*b* by means of hot sealing, the two sheets of inner film 1*a* and 1*b* are positioned between the two sheets of outer film 2*a* and 2*b* and hot sealing points 2*c* are generated by hot sealing so as to adhere the outer film 2*a* to the inner film 1*a* and the outer film 2*b* to the inner film 1*b*. After a heat resistant material 1*c* is spread between the two sheets of inner film 1*a* and 1*b*, a plurality of air inlets 2*e* are formed between the two sheets of inner film 1*a* and 1*b* by not adhering them to each other even by means of hot sealing, and each air inlet 2*e* is corresponding to each first air cylinder 11. Besides, each air inlet 2*e* is connected to an air passageway 14*a*, and a partition portion 15 is then disposed at one end of the air passageway 14, in which the air passageway 14 is formed between the two sheets of inner film 1*a* and 1*b* by adhering the two sheets of inner film 1*a* and 1*b* by means of hot sealing after a heat resistant material is spread between the two sheets of inner film 1*a* and 1*b*, the two sheets of outer film as well as the two sheets of inner film 1*a* and 1*b* are pulled apart outward to open the air inlet 2*e* to allow air to enter the first air cylinder 11 to cause it to be filled with air and expanded after air entering the air inlet 2*e* expands the air filling passageway 12, and air in the first air cylinder 11 can be prevented from flowing back along the air passageway 11 through a blocking portion 15. After the first air cylinder 11 is filled with air and expanded, the internal air pressure in the first air cylinder 11 compresses the two sheets of inner film 1*a* and 1*b* to attach closely onto the outer film 2*a* or 2*b* (depending on a difference of a structure thereof, the two sheets of inner film 1*a* and 1*b* may also not be attached on the outer film 2*a* or 2*b* but hung in the air in the air cylinder 20) to cover the air passageway 14 to shield the first air cylinder 11 to enable the air in the first air cylinder 11 not to be leaked out to attain to the air locking effect.

According to a structure disclosed by the present invention, a plurality of bendable nodes 5 are disposed between the first air cylinder sheet 10, the second air cylinder sheet 20, the third air cylinder sheet 30 and the fourth air cylinder sheet 40 to enable the first air cylinder sheet 10, the second air cylinder sheet 20, the third air cylinder sheet 30 and the fourth air cylinder sheet 40 to be bended along the plurality of nodes 5 to form a U-typed body approximately to be convenient for clamping an article 9 to provide the cushioning protection. Besides, a plurality of bendable blocks 6 may also be disposed at positions such as between the second side air cylinders 22 and the second auxiliary air cylinders 23, between the third side air cylinders 32 and the third auxiliary air cylinders 32 and between the fourth side air cylinders 42 and the fourth auxiliary air cylinders 43.

Please refer to FIGS. 3A and 3B. FIG. 3A is a perspective view, showing a multi-sectional clamping type air enclosure of the first a preferred embodiment according to the present invention after air is filled. FIG. 3B is another perspective view, showing a multi-sectional clamping type air enclosure of the first preferred embodiment according to the present invention after air is filled.

After the multi-sectional clamping type air enclosure of the present invention is filled with air and expanded, first, the first air cylinder sheet 10 and the second air cylinder sheet 20 are allowed to be approximately perpendicular to the third air cylinder sheet 30, and the fourth air cylinder sheet 40 is allowed to be approximately perpendicular to the third air cylinder sheet 30 by bending the air enclosure along the plurality of bendable nodes 5 so as to form a U-typed body. And then, the second auxiliary air cylinders 23, the third auxiliary air cylinders 33 and the fourth auxiliary air cylinders 43 are allowed to bend toward the second main air cylinders 21, the third main air cylinders 31 and the fourth main air cylinders 41 by bending the air enclosure along the bendable blocks 6 to cause the second side air cylinders 22, the third side air cylinders 32 and the fourth side air cylinders 42 to be respectively approximately perpendicular to the second main air cylinders 21, the third main air cylinders 31 and the fourth main air cylinders 41 so as to allow the plurality of third main air cylinders 31 and the plurality of third side air cylinders 32 of the third air cylinder sheet 30 to clamp an article 9, the first air cylinder sheet 10 and the second air cylinder sheet 20 to clamp one side of the article 9 and the fourth air cylinder sheet 40 to clamp an opposite side thereof so as to provide the article 9 with the multi-facial cushioning effect.

Figure 4:
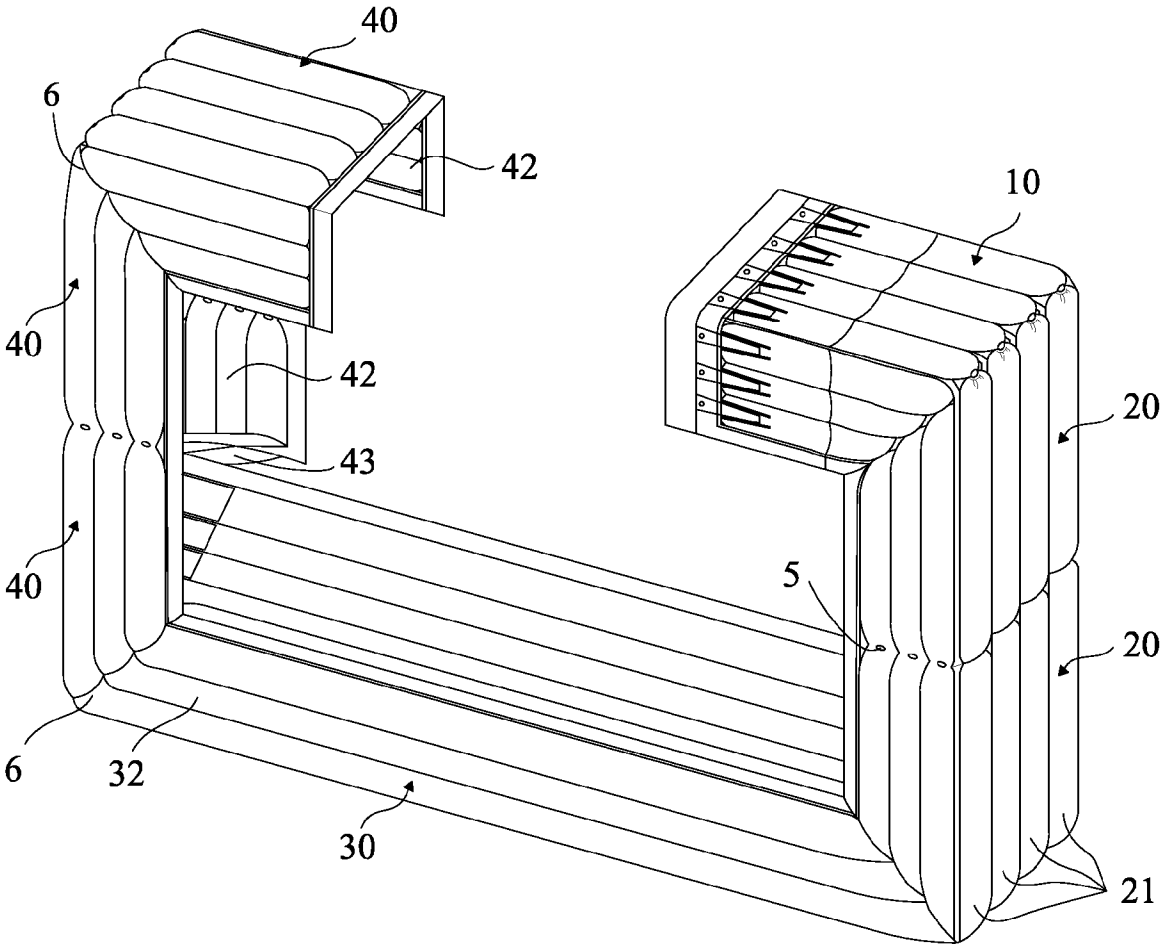
FIG. 4 is a schematic view, showing a multi-sectional clamping type air enclosure of the first preferred embodiment according to the present invention while being bended.

Please refer to FIG. 4. FIG. 4 is a schematic view, showing a multi-sectional clamping type air enclosure of the first preferred embodiment according to the present invention while being bended.

A user may bend the air enclosure along the plurality of bendable blocks 6 to cause the fourth auxiliary air cylinders 43 of the fourth air cylinder sheet 40 farther away from the third air cylinder sheet 30 to bended toward the fourth main air cylinders 41 to cause the fourth air cylinder sheet 40 farthest away from the third air cylinder sheet 30 to be approximately parallel to the third air cylinder sheet 30 so as to form a cover to be able to clamp one side of the article 9 far away from the third air cylinder sheet 30. Besides, the user may bend the air enclosure along the plurality of bendable blocks 6 to cause the second auxiliary air cylinders 23 of the second air cylinder sheet 20 farther away from the third air cylinder sheet 30 to be bended toward the second main air cylinders 21 and the first air cylinder sheet 10 to be bended along the plurality of bendable nodes 5 to allow the first air cylinder sheet 10 to be approximately parallel to the third air cylinder sheet 30 to form a cover so that the side of the article 9 far away from the second air cylinder sheet 30 can be clamped.

Figure 5A:
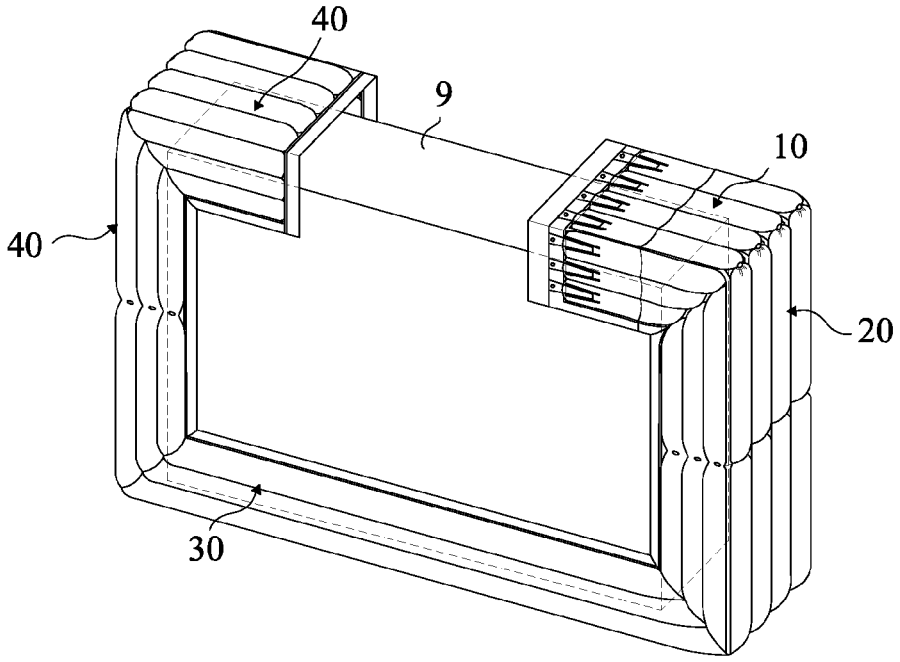
FIG. 5A is a schematic view, showing a wrapped article of the first preferred embodiment according to the present invention after being bended.
Figure 5B:
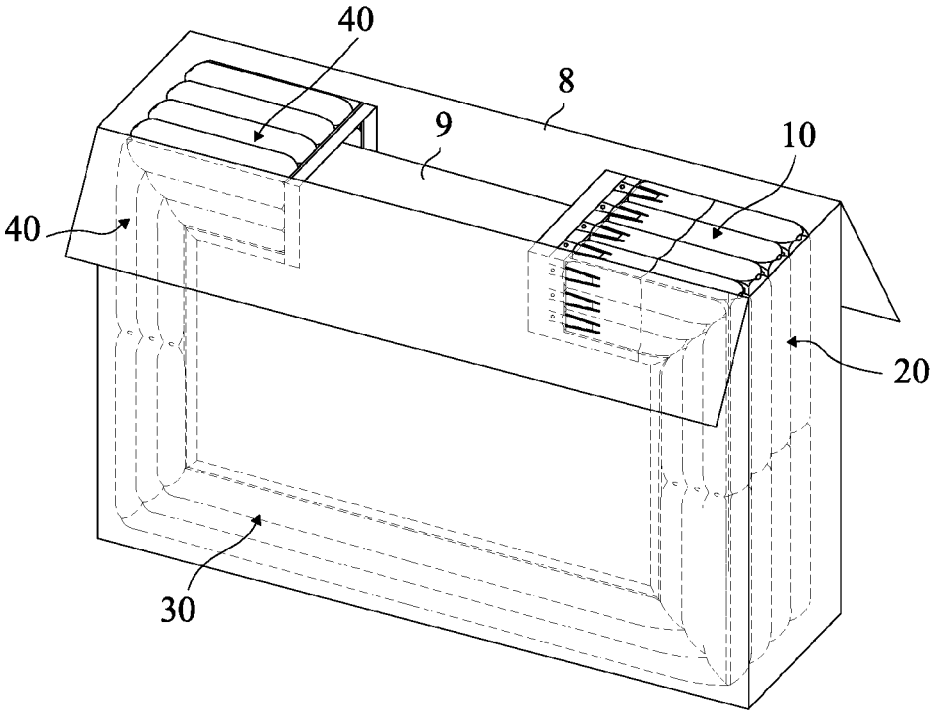
FIG. 5B is another schematic view, showing a wrapped article of the first preferred embodiment according to the present invention after being bended.
Figure 6:
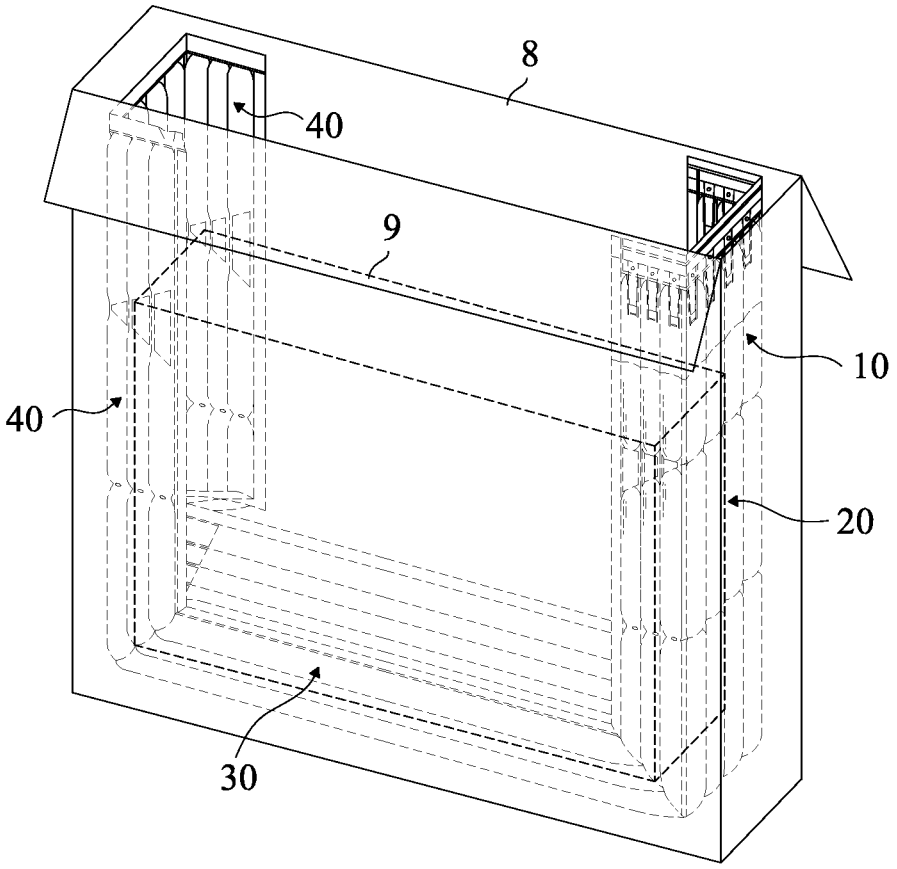
FIG. 6 is a schematic view, showing a wrapped article of a preferred embodiment according to the present invention.

Please refer to FIGS. 5A, 5B and 6. FIG. 5A is a schematic view, showing a wrapped article of the first preferred embodiment according to the present invention after being bended. FIG. 5B is another schematic view, showing a wrapped article of the first preferred embodiment according to the present invention after being bended. FIG. 6 is a schematic view, showing a wrapped article of a preferred embodiment according to the present invention.

When the first air cylinder sheet 10 and the fourth air cylinder sheet 40 are bended to form the cover, a wrapped article can be placed in a smaller outer box 8 for transportation; if the cover is not formed by bending, a wrapped article can be placed in a larger outer box 8 for transportation. Thereby, a user may place a wrapped article in the outer box 8 with a different size depending on a packing requirement by bending the first air cylinder sheet 10, the second air cylinder sheet 20, the third air cylinder sheet 30 or the fourth air cylinder sheet 40.

Figure 7:
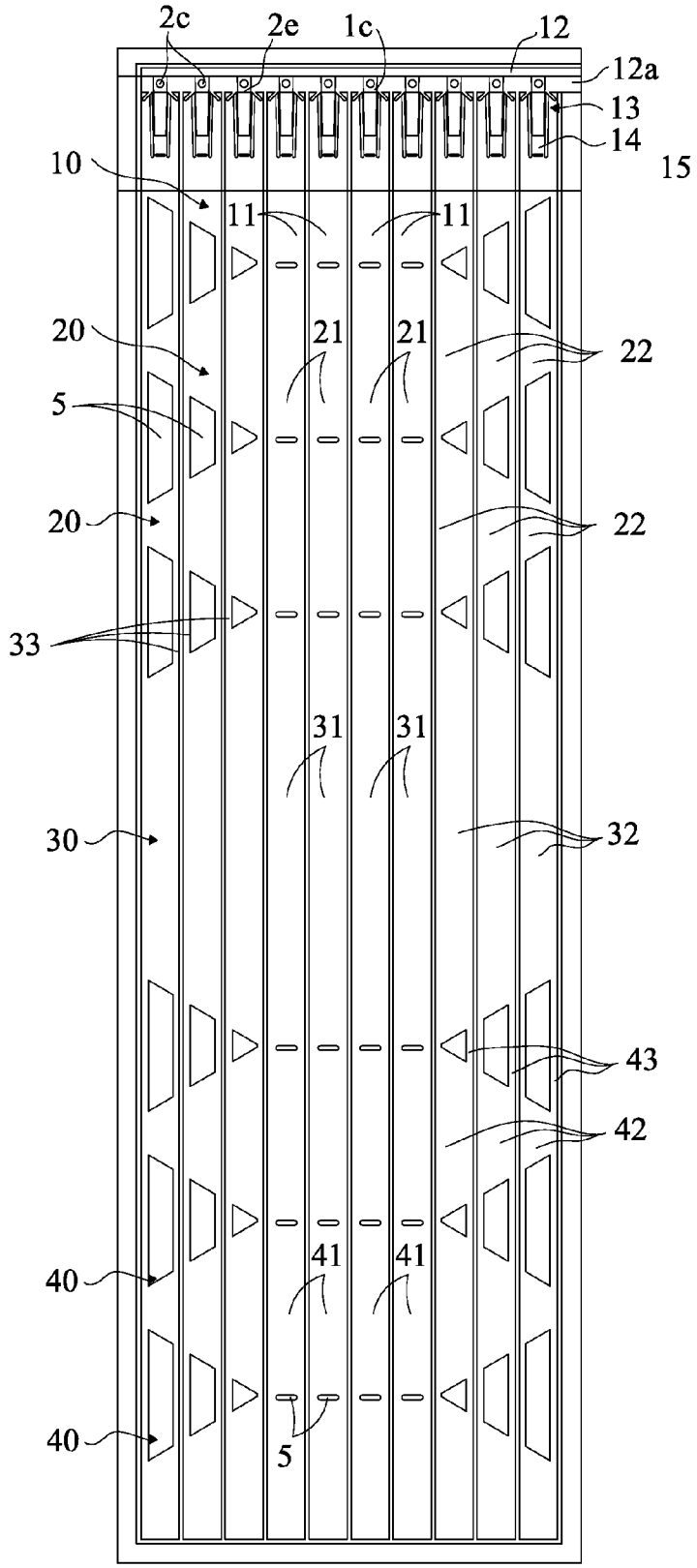
FIG. 7 is a plain view, showing a multi-sectional clamping type air enclosure of a second preferred embodiment according to the present invention before air is filled.
Figure 8:
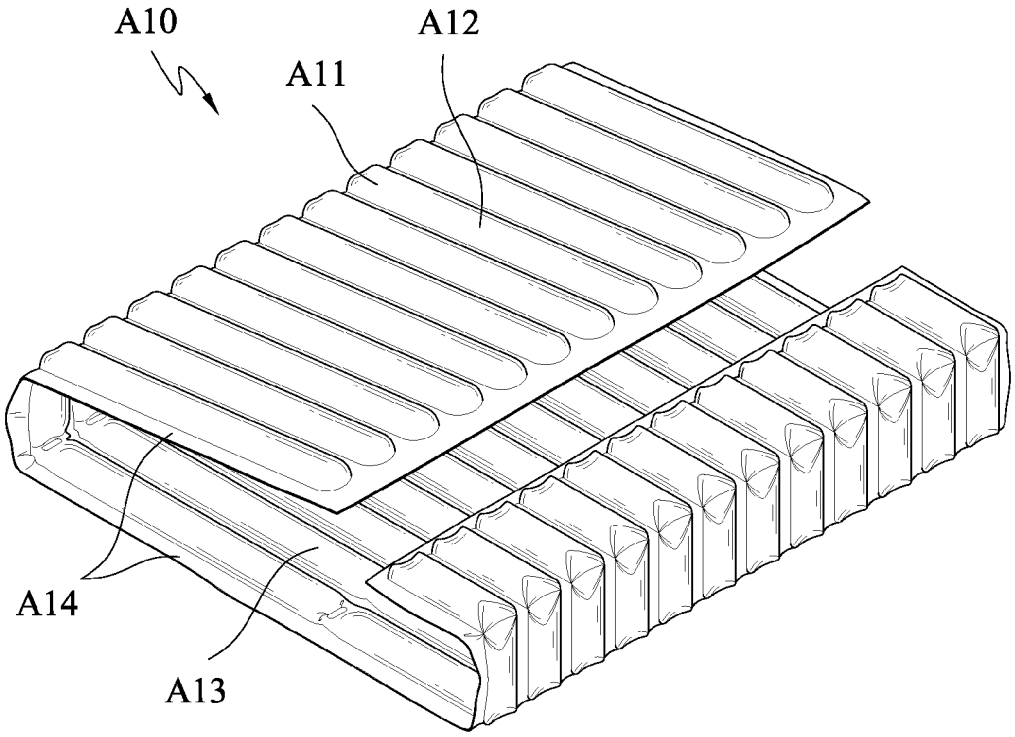
FIG. 8 is a schematic view of a conventional air packing bag.
Figure 9:
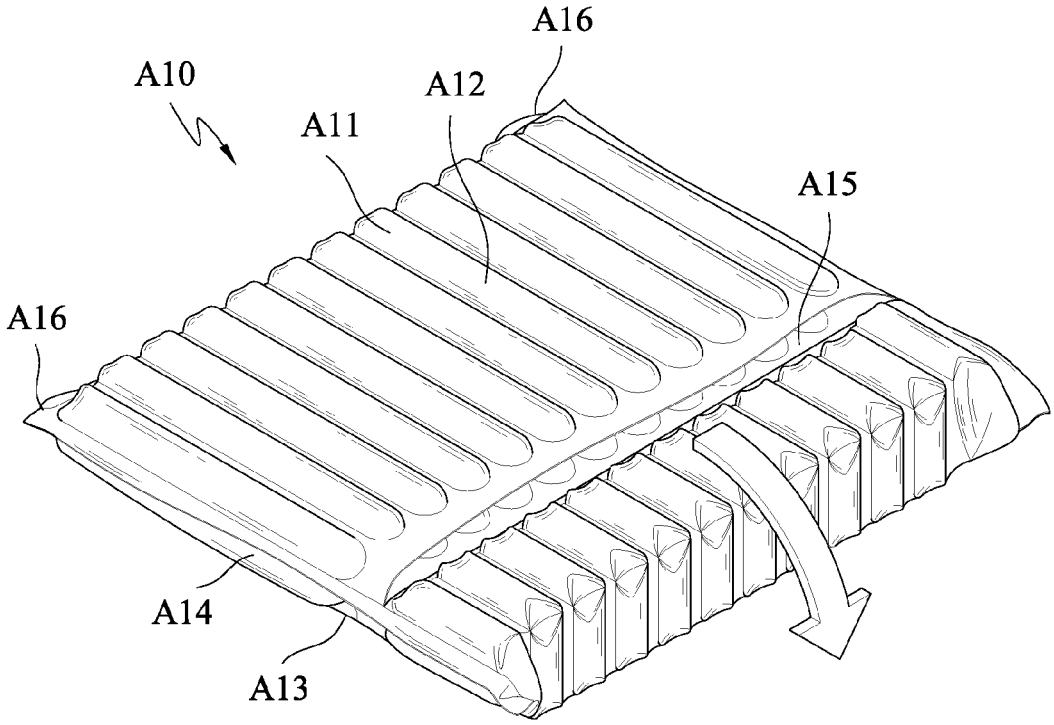
FIG.9 (PRIOR ART)
FIG. 9 is a schematic view of another conventional air packing bag.

Please refer to FIG. 7. FIG. 7 is a plain view, showing a multi-sectional clamping type air enclosure of a second preferred embodiment according to the present invention before air is filled.

A plurality of foldable blocks 7 may also be disposed on the plurality of first air cylinders 11 of the first air cylinder sheet 10 to allow the first air cylinder sheet 10 to be bended along the plurality of bendable blocks 7, in which the foldable blocks 7 may be formed by adhering the two sheets of outer film 2*a* and 2*b* to each other by means of hot sealing, and may also be formed by adhering the two sheets of outer film 2*a* and 2*b* to each other as well as the two sheets of inner film 1*a* and 1*b* to each other by means of hot sealing. Besides, two ends of each four side air cylinder 42 may respectively be communicated with the four auxiliary air cylinders 43, and a sum of lengths of the four auxiliary air cylinders 43 and the fourth side air cylinder 42 is approximately equal to a length of the fourth main air cylinder 41.

The air enclosure of the present invention may be used for clamping the article 9 with a different shape or size to provide the multi-facial cushioning effect, and the article can be accepted in the outer box 8 with a different size by bending the first air cylinder sheet 10, the second air cylinder sheet 20, the third air cylinder sheet 30 and the fourth air cylinder sheet 40. Thereby, according to the present invention, manufacturing processes can be simplified, the production efficiency can be elevated during the manufacturing, articles with a different shape or size all can share the same air enclosure without needing to prepare air enclosure with a different size during the packing, and a wrapped article can be placed in an outer box with a different size for transportation. Therefore, the cost reducing object not only on the manufacturing processes but on he packing procedures can all be obtained.

Although two second air cylinder sheets 20 and three four air cylinder sheets 40 are taken as an example to describe as above, the present invention is not limited to the only disposition of two second air cylinder sheets and three air cylinder sheets, the number of second air cylinder sheets and four air cylinder sheets may also be decided depending on the practical need, it is hereby explained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A multi-sectional clamping type air enclosure, comprising:

two outer films stacked together;

two inner films stacked together and having two faces and positioned and enclosed between the two outer films;

two parallel hot sealing lines positioned on one end of the two outer films for adhering the two outer films together, a first one of the hot sealing lines adhering the two outer films together and a second one adhering both the two outer films and the two inner films together;

an air filling passageway positioned between the two hot sealing lines and including a space formed between the two outer films;

a first air cylinder body including an air storable space defined between the two outer films at the opposite side of the second hot sealing line from the air filling passage and comprising a plurality of first air cylinders, wherein one end of the two inner films is disposed in the air filling passageway and another end is positioned in the first air cylinder body;

a plurality of air inlets formed between the air filling passage and the first air cylinder body through the second one of the hot sealing lines, respectively in communication with the plurality of first air cylinders;

a first hot sealing point and a second hot sealing point positioned in the air filling passageway and between the two hot sealing lines, the first hot sealing point lying between one of the two outer films and one of the two inner films which are adhered to each other at the first hot sealing point, the second hot sealing point lying between the other of the two outer films and the other of the two inner films which are adhered to each other at the second hot sealing point, wherein air entering said air filling passageway expands said air filling passageway, allowing the two outer films to be pushed apart outward from each other to thereby drive said inner films, that are not fixed to each other, to be pulled apart outward via said first hot sealing point and via said second hot sealing point;

at least one second air cylinder body including an air storable space defined between the two outer films and communicating with the first air cylinder body, the second air cylinder body comprising:

a plurality of second main air cylinders;

a plurality of second side air cylinders; and a plurality of second auxiliary air cylinders disposed side by side with the second side air cylinders at two sides of the plurality of second main air cylinders, each of the second side air cylinders communicating with at least one second auxiliary air cylinder, a first of the second auxiliary air cylinders being farther away from the plurality of second main air cylinders than a second of the second auxiliary air cylinders, the first of the second auxiliary air cylinders having a length greater than a length of the second of the second auxiliary air cylinders that is closer to the plurality of second main air cylinders;

a third air cylinder body communicating with the second air cylinder body and comprising:

a plurality of third main air cylinders; and a plurality of third side air cylinders; and a plurality of third auxiliary air cylinders disposed side by side with the third side air cylinders at two sides of the plurality of third main air cylinders, each of the third side air cylinders communicating with at least one third auxiliary air cylinder, a first of the third auxiliary air cylinders being farther away from the plurality of third main air cylinders than a second of the third auxiliary air cylinders, the first of the third auxiliary air cylinders having a length greater than a length of the second of the third auxiliary air cylinders;

at least one fourth air cylinder body communicating with the third air cylinder body and comprising:

a plurality of fourth main air cylinders;

a plurality of fourth side air cylinders; and a plurality of fourth auxiliary air cylinders disposed side by side with the fourth side air cylinders at two sides of the plurality of fourth main air cylinders, each of the fourth side air cylinders in communication with at least one fourth auxiliary air cylinder, a first of the fourth auxiliary air cylinders being farther away from the plurality of fourth main air cylinders than a second of the fourth auxiliary air cylinders, the first of the fourth auxiliary air cylinders having a length greater than a length of the second of the fourth auxiliary air cylinders that is closer to the plurality of fourth main air cylinders; and a plurality of air entering passageways connected to the air filling passageway and the first air cylinder body, and formed on one or more of the faces of the inner films, the air enters to expand the air filling passageway, the two faces of the inner films being adapted to be driven to pull apart outward at the hot sealing points to open the air entering passageway, causing the air in the air filling passageway to enter the first air cylinder body through the air entering passageways to allow the first air cylinder body and the second cylinder body to be filled with air and expanded, the air entering the first air cylinder body and then compressing at least one of the inner films to cover the air entering passageways to shield the first air cylinder body and the second air cylinder body, one or more of the auxiliary air cylinders being bent toward one or more of the main air cylinders to cause one or more of the side air cylinders to be approximately perpendicular to the one or more main air cylinders to clamp an article after the second air cylinder body and the fourth air cylinder body are bent toward the third air cylinder body.

2. The multi-sectional clamping type air enclosure according to claim 1, further comprising a blocking portion positioned at one end of at least one of the air entering passageways.

3. The multi-sectional clamping type air enclosure according to claim 1, further comprising a plurality of bendable nodes positioned between the air cylinders.

4. The multi-sectional clamping type air enclosure according to claim 1, further comprising a plurality of bendable blocks positioned between the side air cylinders and the auxiliary air cylinders.

5. The multi-sectional clamping type air enclosure according to claim 1, further comprising a plurality of foldable blocks positioned on the plurality of first air cylinders.

6. The multi-sectional clamping type air enclosure according to claim 1, wherein the second auxiliary air cylinder is in communication with the third auxiliary air cylinder.

7. The multi-sectional clamping type air enclosure according to claim 1, wherein the third auxiliary air cylinder is in communication with the fourth auxiliary air cylinder.

8. The multi-sectional clamping type air enclosure according to claim 1, wherein the air cylinder bodies include air storable spaces defined between a plurality of hot sealing portions and between the two outer films which are adhered to each other along the plurality of hot sealing portions.

9. The multi-sectional clamping type air enclosure according to claim 1, wherein the number of the second air cylinders is two, and the first air cylinder body and the second air cylinder body are bent to cause the first air cylinder body to be approximately parallel to the third air cylinder body.

10. The multi-sectional clamping type air enclosure according to claim 1, wherein the number of the fourth air cylinder bodies is four, and the fourth air cylinder body is bent to cause the fourth air cylinder body farthest away from the third air cylinder body to be approximately parallel to the third air cylinder body.

11. The multi-sectional clamping type air enclosure according to claim 1, wherein the number of the fourth air cylinder bodies is three, and the fourth air cylinder body is bent to cause the fourth air cylinder body to be the farthest air cylinder body away from the third air cylinder body and to be approximately parallel to the third air cylinder body.

* * * * *